US011046569B2

(12) United States Patent
Russell et al.

(10) Patent No.: US 11,046,569 B2
(45) Date of Patent: Jun. 29, 2021

(54) BEVERAGE DISPENSING SYSTEM

(71) Applicant: Winter Creek Designs, Needville, TX (US)

(72) Inventors: Justin Russell, Needville, TX (US); Christopher Rojas, Pearland, TX (US); Christian LaForgia, Woodcliff Lake, NJ (US); David Finneran, Plantation, FL (US)

(73) Assignee: Winter Creek Designs, Needville, TX (US)

( * ) Notice: Subject to any disclaimer, the term of this patent is extended or adjusted under 35 U.S.C. 154(b) by 0 days.

(21) Appl. No.: 16/667,995

(22) Filed: Oct. 30, 2019

(65) Prior Publication Data

US 2020/0071152 A1 Mar. 5, 2020

Related U.S. Application Data

(63) Continuation of application No. 16/134,922, filed on Sep. 18, 2018, now Pat. No. 10,494,247, which is a continuation of application No. 15/491,524, filed on Apr. 19, 2017, now Pat. No. 10,106,393.

(51) Int. Cl.

| | |
|---|---|
| ***B67D 1/04*** | (2006.01) |
| ***B67D 1/00*** | (2006.01) |
| ***B67D 1/08*** | (2006.01) |

(52) U.S. Cl.

CPC ..... *B67D 1/0462* (2013.01); *B67D 1/0001* (2013.01); *B67D 1/0406* (2013.01); *B67D 1/0425* (2013.01); *B67D 1/0891* (2013.01)

(58) Field of Classification Search

CPC ..... A61M 5/1483; A61M 5/148; A61M 2005/145; A61M 2005/14506; B67D 7/0244; B67D 7/0255; B67D 1/0462; B67D 1/0001; B67D 1/0406; B67D 1/0425; B67D 1/0891; B65D 77/06

See application file for complete search history.

(56) References Cited

U.S. PATENT DOCUMENTS 1,965,271 A * 7/1934 Wharton ..... F16N 37/02 222/95
2,766,907 A 10/1956 Wallace, Jr.
3,029,987 A * 4/1962 Gronemeyer ..... B05C 17/00506 222/541.4

(Continued)

FOREIGN PATENT DOCUMENTS

EP 2281753 A1 2/2011

OTHER PUBLICATIONS

KeyKeg Corporate Brochure. Nov. 12, 2015.
Carbotek. Beer-in-Box Flyer. Oct. 2014.

*Primary Examiner* — Paul R Durand
*Assistant Examiner* — Randall A Gruby

(57) ABSTRACT

The present disclosure describes a system, apparatus, and method for storing, transporting, delivering, and dispensing carbonated beverages that maintains a high degree of carbonation and extends the shelf life of the beverage. The system includes a container that includes an outlet for dispensing the beverage. Disposed within the container is a first bladder that contains a fluid and an apparatus for exerting a constant pressure on the first bladder. The fluid is dispensed from the first bladder through the outlet, in response to the apparatus exerting pressure on the first bladder.

15 Claims, 7 Drawing Sheets

(56) References Cited

U.S. PATENT DOCUMENTS 3,294,289 A 12/1966 Bayne
3,300,102 A * 1/1967 Budzich ..... B67D 1/045 222/386.5
3,323,682 A * 6/1967 Creighton, Jr. ... B05C 17/00516 222/94
3,389,838 A * 6/1968 Morrapeterj ..... B05C 17/01 222/630
3,417,901 A * 12/1968 Sands ..... B65D 83/62 222/95
3,561,644 A 2/1971 Works
3,884,396 A * 5/1975 Gordon ..... G01F 11/026 222/327
3,896,970 A * 7/1975 Laauwe ..... B65D 83/62 222/94
3,949,911 A * 4/1976 Morane ..... B65D 83/62 222/386.5
3,998,072 A * 12/1976 Shaw ..... B65D 81/3876 62/457.4
4,033,479 A 7/1977 Fletcher
4,249,677 A * 2/1981 Davis, Jr. ..... B05C 17/012 222/326
4,255,944 A * 3/1981 Gardner ..... B65D 81/3876 62/371
4,265,373 A * 5/1981 Stoody ..... B65D 83/62 222/386.5
4,432,473 A * 2/1984 MacEwen ..... B65D 83/0072 222/327
4,518,103 A * 5/1985 Lim ..... B65D 83/663 222/135
4,626,243 A * 12/1986 Singh ..... A61M 5/141 138/44
4,669,636 A * 6/1987 Miyata ..... B05C 17/0103 222/153.01
4,711,373 A * 12/1987 Christine ..... A47K 5/122 222/105
4,756,450 A * 7/1988 Negaty-Hindi ..... B67D 1/0001 222/105
4,757,920 A * 7/1988 Harootian, Jr. ..... B67D 1/0869 220/4.22
4,771,918 A * 9/1988 Haggart ..... B65D 83/0061 222/95
4,796,788 A 1/1989 Bond
4,812,054 A * 3/1989 Kirkendall ..... A45C 3/04 383/110
4,857,055 A 8/1989 Wang
4,902,278 A 2/1990 Maget
4,921,135 A * 5/1990 Fleet ..... B67B 7/26 222/105
4,961,324 A * 10/1990 Allan ..... A47J 41/00 62/400
5,096,092 A 3/1992 Devine
5,161,715 A * 11/1992 Giannuzzi ..... B05C 17/00506 222/105
5,240,144 A * 8/1993 Feldman ..... B67D 1/0001 222/105
5,257,987 A 11/1993 Athayde
5,305,920 A 4/1994 Reiboldt
5,318,540 A 6/1994 Athayde
5,399,166 A 3/1995 Laing
5,443,181 A * 8/1995 Popp ..... B05C 17/00576 222/137
5,492,534 A 2/1996 Athayde
5,516,004 A 5/1996 Lane
5,551,601 A 9/1996 Camm
5,681,284 A 10/1997 Herskowitz
5,700,245 A * 12/1997 Sancoff ..... A61M 5/14593 222/399
5,707,361 A 1/1998 Slettenmark
5,738,657 A 4/1998 Bryant
5,775,539 A * 7/1998 Bates ..... B05C 17/0103 222/1
5,891,097 A * 4/1999 Saito ..... A61M 5/1483 604/131
6,056,157 A 5/2000 Gehl
6,062,429 A 5/2000 West
6,067,906 A 5/2000 Ryan
6,111,187 A 8/2000 Goyette
6,170,715 B1 * 1/2001 Evans ..... B67D 1/0001 222/340
6,234,351 B1 * 5/2001 Wilcox ..... B65D 77/06 222/386.5
6,234,352 B1 5/2001 Richard
6,394,981 B2 5/2002 Heruth
6,398,760 B1 * 6/2002 Danby ..... A61M 5/1483 604/132
6,460,736 B1 * 10/2002 D'Agostino ..... A23G 1/202 222/146.5
6,564,970 B1 * 5/2003 Walch ..... B05C 17/00586 222/82
6,732,485 B2 * 5/2004 Lett ..... E04F 13/0832 52/742.13
6,763,973 B1 7/2004 Hudkins
6,789,707 B2 9/2004 Wright
6,811,056 B2 * 11/2004 Gabes ..... B64D 11/04 222/103
6,874,659 B2 * 4/2005 Schiestl ..... B65D 83/62 222/105
7,086,566 B2 8/2006 Goepfert
7,225,824 B2 * 6/2007 West ..... B65D 75/58 137/15.01
7,334,703 B2 * 2/2008 Schiestl ..... B65D 83/62 141/20
7,498,050 B2 * 3/2009 Kincaid ..... A23D 7/0056 426/115
7,954,670 B2 * 6/2011 Stuart ..... B65D 77/06 222/105
8,006,873 B2 8/2011 Vanblaere et al.
8,118,893 B2 2/2012 Rosenzweig et al.
8,348,173 B2 1/2013 Shin
8,360,278 B2 * 1/2013 Fiedler ..... B67D 1/0009 222/95
8,459,503 B2 6/2013 Groesbeck
8,528,785 B2 * 9/2013 Naughton ..... B05C 17/00553 222/137
8,544,686 B2 * 10/2013 Williams ..... B05B 11/02 222/105
8,579,161 B2 * 11/2013 Steeb ..... A21C 5/006 222/146.6
8,596,496 B2 * 12/2013 Malinski ..... B67D 3/0009 222/105
8,740,021 B2 * 6/2014 Naughton ..... G01F 11/00 192/54.5
8,800,814 B2 * 8/2014 Braun ..... B65D 77/067 222/105
8,857,672 B2 * 10/2014 Naughton ..... B05C 17/01 222/325
8,960,502 B2 * 2/2015 Stehli, Jr. ..... B05B 11/047 222/386.5
9,039,557 B2 * 5/2015 Naughton ..... B05C 17/0103 221/229
9,051,167 B2 6/2015 Burge et al.
9,114,971 B2 8/2015 Rasmussen et al.
9,428,326 B2 * 8/2016 Seibold ..... B65D 77/061
9,708,113 B1 7/2017 Seibold
9,839,928 B2 * 12/2017 Park ..... B05B 15/30
10,005,098 B2 * 6/2018 Hsu ..... B05C 17/0103
2001/0002675 A1 * 6/2001 Wilcox ..... B65D 77/06 222/95
2004/0007589 A1 1/2004 Leveen
2004/0226968 A1 * 11/2004 Lafond ..... B05C 17/00559 222/327
2005/0023292 A1 * 2/2005 Market ..... A45F 3/20 222/105
2008/0105711 A1 5/2008 Kirimli et al.
2009/0108033 A1 * 4/2009 Quinn ..... B05C 17/00516 222/568
2009/0212071 A1 * 8/2009 Tom ..... B65D 33/00 222/95

(56) References Cited

U.S. PATENT DOCUMENTS

| | | | | |
|---|---|---|---|---|
| 2012/0104047 | A1* | 5/2012 | Lim | A61K 31/46<br>424/43 |
| 2012/0111894 | A1 | 5/2012 | Bakhos | |
| 2014/0276587 | A1 | 9/2014 | Imran | |
| 2014/0231427 | A1 | 10/2014 | Botet | |
| 2015/0008242 | A1* | 1/2015 | Kpabar, Jr. | B67D 3/0061<br>222/183 |
| 2015/0053717 | A1* | 2/2015 | Williams | B05C 17/0126<br>222/95 |
| 2015/0190839 | A1* | 7/2015 | Hunt | B05C 17/0146<br>222/545 |
| 2015/0284147 | A1* | 10/2015 | Patey | B65D 35/56<br>222/1 |
| 2016/0128351 | A1* | 5/2016 | Rubin | B67D 3/0012<br>222/95 |
| 2016/0347597 | A1* | 12/2016 | Schlecht, Jr. | B67D 1/0891 |
| 2017/0073147 | A1* | 3/2017 | Kuhn | B65D 81/3823 |

* cited by examiner

BEVERAGE DISPENSING SYSTEM

CROSS-REFERENCE TO RELATED APPLICATIONS

The present application is a continuation of co-pending U.S. application Ser. No. 16/134,922, entitled "Beverage Dispensing System" and filed on Sep. 18, 2018, which is a continuation of U.S. application Ser. No. 15/491,524, entitled "Beverage Dispensing System" and filed on Apr. 19, 2017, which issued as U.S. Pat. No. 10,106,393 on Oct. 23, 2018, the entireties of which are hereby incorporated by reference.

BACKGROUND OF THE INVENTION

(1) Field of the Invention

The present application is directed to a system, apparatus, and method for the improved storage, transportation, delivery, and dispensing of carbonated beverages.

(2) Description of Related Art

Carbonated beverages are traditionally stored, transported, and consumed from a can, bottle, or other large vessel. Cans and bottles typically contain 12 fluid ounces (fl. oz.) with six, twelve, or twenty-four cans or bottles per container. However, the cylindrical design of cans and bottles results in inefficient packing. Moreover, glass bottles are much heavier than aluminum cans or bottles resulting in greater transportation costs. Furthermore, in several states, glass bottles are returned to the brewer, which must clean and sanitize the bottles before reusing.

In addition to the shortcomings with cans and bottles discussed above, large vessels, such as 2 liter bottles and kegs, have an additional shortcoming in that a small percentage of the beverage will be wasted. Additionally, beverages that are stored in large vessels present a greater risk of oxidation and loss of carbonation. Kegs also present a number of disadvantages. For example, the weight of kegs increases shipping costs. Furthermore, kegs must be returned, and the tracking of each keg between the producer, distributor, and retailer is a logistical problem resulting in yet additional costs. Additionally, a separate tap represents an additional expense for consumers. Finally, the carbonated beverages in kegs risk oxidation and loss of carbonation if the beverage is not consumed in a timely fashion.

BRIEF SUMMARY OF THE INVENTION

According to one aspect of the disclosure, a system for storing, transporting, delivering, and dispensing carbonated beverages that maintains a high degree of carbonation and extends the shelf life of the beverage. The system includes a container with an outlet for dispensing a liquid. Additionally, the container contains a first bladder for storing a liquid and a second bladder to exert pressure on the first bladder to dispense the liquid contained in the first bladder. A pump may be attached to the second bladder, through the container, to fill the second bladder, for example, with atmosphere, a gas, or other fluid. In some examples, the system includes a support structure that holds the first and second bladder inside the container. According to some examples, the second bladder is adjacent to the first bladder. In other examples, the second bladder is located within the first bladder.

According to another aspect of the disclosure, a system for storing, transporting, delivering, and dispensing beverages includes a container with an outlet for dispensing a liquid. The container also contains a first bladder that stores a liquid and a diaphragm that exerts pressure on the bladder to dispense the liquid. The system includes a diaphragm to raise and lower the diaphragm to control the pressure on the first bladder.

DETAILED DESCRIPTION OF THE INVENTION

As discussed above, carbonated beverages contain dissolved carbon dioxide at pressures greater than atmospheric pressure. However, once a carbonated beverage is opened to the atmosphere, the beverage slowly loses carbonation due to Henry's Law. To compensate for this loss in carbonation, carbonated beverage packagers fill the headspace of the container with carbon dioxide. However, once the container is opened, the partial pressure slowly returns to atmospheric conditions. As carbon dioxide accounts for less than 1% of the gas particles in the atmosphere, the dissolved carbon dioxide will leave the solution (e.g. carbonated beverage) and escape from the container, which results in the beverage losing carbonation and becoming "flat."

The present disclosure describes a system, apparatus, and method for storing, transporting, delivering, and dispensing carbonated beverages that maintains a high degree of carbonation and extends the shelf life of the beverage. The system includes a container that includes an outlet for dispensing a beverage. The container may include a support structure. Disposed within the container and the support structure is a first bladder that is connected to the outlet. The first bladder contains a liquid that is dispensed through the outlet. The system includes a second bladder to exert pressure on the first bladder. As liquid is dispensed from the first bladder, the second bladder increases in pressure and expands in volume to exert pressure on the first bladder, thereby forcing the liquid toward lower pressure (e.g., the outlet valve). In this regard, a constant total volume may be maintained between the first and second bladders. Increasing the volume of the second bladder maintains pressure on the first bladder to sustain greater than atmospheric pressure on the first bladder to minimize the amount of atmosphere flowing back into the first bladder and reduce the formation of additional headspace. By minimizing the formation of additional headspace, the examples of the present disclosure reduce the loss of carbon dioxide dissolved in the liquid stored in the first bladder. This represents an improvement over prior art systems that permit atmosphere to flow into the vessel, thereby creating additional headspace for dissolved carbon dioxide to escape from the liquid.

Figure 1:
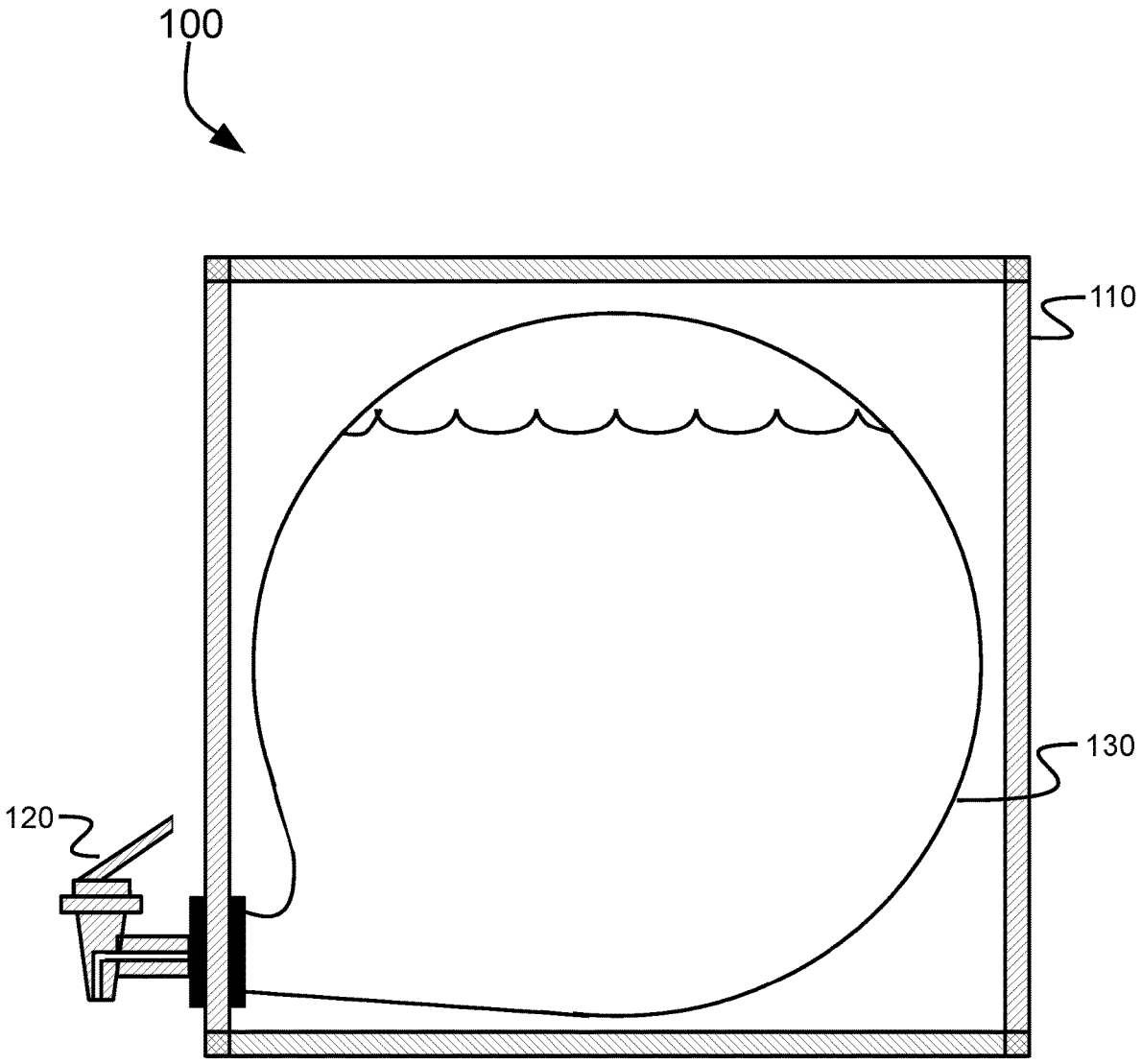
Figure 1 (Prior Art)
FIG. 1 shows a prior art beverage dispensing system.

Containers containing a bladder for dispensing beverages are known in the art. The most notable being a bladder contained within a box for dispensing wine, colloquially known as wine-in-a-box. FIG. 1 illustrates a prior art beverage dispensing system 100 that includes a bladder within a container. The beverage dispensing system 100 includes a container 110. The container 110 is typically rectangular in shape; however, the container 110 may be cylindrical or any other suitable shape. The container 110 also contains an outlet 120. The outlet valve 120 is connected to a bladder 130 located within the container 110. The outlet valve 120 dispenses the liquid contained in the bladder 130. The bladder 130 may include any suitable food grade material or combination of food grade materials. For example, bladder 130 may be manufactured from one or more polymers, including plastics, nylons, EVOH, polyolefins, or other natural or synthetic polymers. Alternatively, bladder 130 may be produced using polyethylene terephthalate (PET), polyethylene naphthalate (PEN), poly(butylene 2,6-naphthalate) (PBN), polyethylene (PE), linear low-density polyethylene (LLDPE), low-density polyethylene (LDPE), medium-density polyethylene (MDPE), high-density polyethylene (HDPE), polypropylene (PP), and/or fluoropolymer, such as but not limited to, Polychlorotrifluoroethylene (PCTFE), polytetrafluoroethylene (PTFE), fluorinated ethylene propylene (FEP), and perfluoroalkoxy (PFA).

Figure 2:
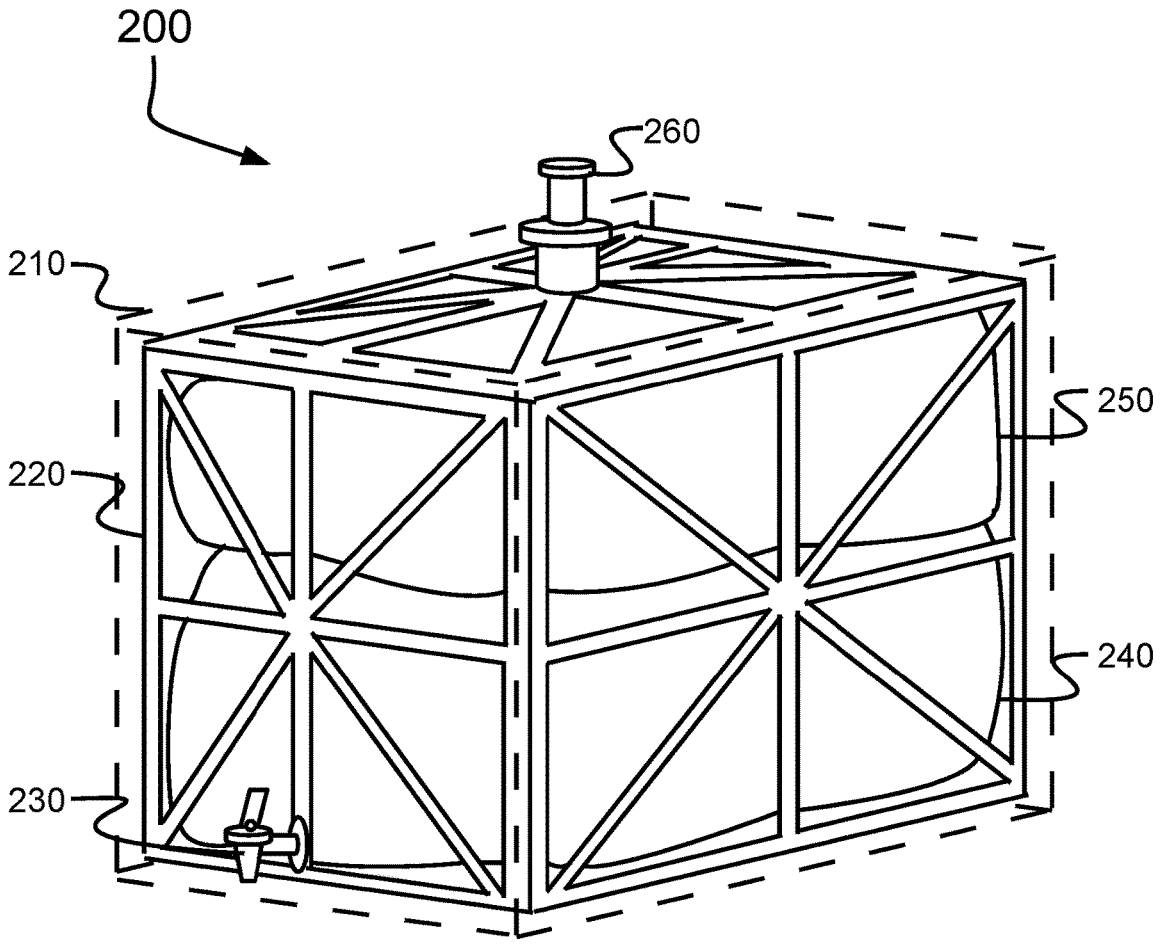
FIG. 2 illustrates an embodiment of a dual-bladder beverage dispensing system.

While prior art systems show a beverage dispensing system that includes a bladder disposed within a container, these systems are not equipped to accommodate fluids under pressure, especially carbonated beverages. FIG. 2 illustrates a bladder-on-bladder beverage dispensing system 200 for carbonated beverages that prevents the loss of carbonation and extends shelf life of the carbonated beverages. Bladder-on-bladder beverage dispensing system 200 includes a container 210. Container 210 includes a support structure 220, an outlet 230, and a pump 260. Within the support structure there is a first bladder 240 and a second bladder 250.

Container 210 may be made from any suitable material, including a waterproof material. Alternatively, the container 210 may be made from cardboard and coated in a water resistant material. A plurality of interconnected panels connected to the base to for the container. The container 210 is preferably rectangular-shaped, although other shapes may be used for the container, such as cylindrical. Support structure 220 is disposed within container 210. The support structure 220 would provide additional support to the beverage dispensing system 200, especially with respect to rectangular-shaped containers. In this regard, square vessels typically do not behave well under pressure, at least not as well as cylindrical containers. Support structure 220 provides additional support to compensate for the poor performance rectangular-shaped containers typically exhibit with fluids under pressure. Accordingly, support structure 220 may be made from a durable plastic, such as polyurethanes, polyesters, epoxy resins, and phenolic resins. Support structure 220 may also be produced as a molded plastic to form compartments between support structure 220 and the interior of container 210. The compartments may be filled with ice or other material (e.g. dry ice) to cool the liquid contained in first bladder 240. Additionally, support structure 220 may include a first channel (not shown) to connect outlet 230 to first bladder 240 and a second channel (not shown) to connect pump 260 to second bladder 250.

In preferred embodiments, outlet 230 may include a valve built into the container 210. Outlet 230 may be a spigot that opens to release the liquid from first bladder 240. In some embodiments, outlet 230 may be a one-way check valve to reduce the amount of air flowing into first bladder 240. Alternatively, outlet 230 may be an interface where a dispensing unit or tubing may be attached. In this regard, the dispensing unit and/or tubing may connect to a jockey box to chill the fluid contained in first bladder 240 prior to being dispensed through outlet 230. As noted above, outlet 230 connects to the first bladder 240 via a channel in the support structure 220. According to some embodiments, support structure 220 may include a compartment proximately located to the channel to store ice or other material to cool the liquid contained in first bladder 240 prior to it being dispensed.

Similar to outlet 230, pump 260 may be built into the container 210. In this regard, pump 260 may be connected to the second bladder 250 through a channel in the support structure. According to some examples, pump 260 may manually fill second bladder 260 with atmosphere through a pumping action. Alternatively, pump 260 may automatically fill the second bladder 250 with a gas, such as carbon dioxide or nitrous oxide. Accordingly, the pump 260 may include a cartridge containing the gas. The cartridge may contain a regulator and/or check valve. The cartridge may be connected to outlet 230 such that when outlet 230 is opened pump 260 is activated to fill the second bladder 250 with gas and dispense the liquid from the first bladder 240. In still yet alternative embodiments, second bladder 260 may be filled with a dense fluid. According to these embodiments, the dense fluid may be stored in a reservoir (not shown) and flow into second bladder 250. For example, the dense fluid may flow in response to a person opening outlet 230. In this regard, there may be an actuator connected to the reservoir to permit the dense fluid to flow from the reservoir into second bladder 250.

The first bladder 240 is a bladder made of food-grade material configured to hold a fluid, such as a carbonated beverage. In preferred embodiments, the first bladder 240 is cubic-shaped and made from any suitable food-grade material. For example, the first bladder 240 may include any suitable food-grade material or combination of food-grade materials, such as one or more polymers, including plastics, nylons, EVOH, polyolefins, or other natural or synthetic polymers, polyethylene terephthalate (PET), polyethylene naphthalate (PEN), poly(butylene 2,6-naphthalate) (PBN), polyethylene (PE), linear low-density polyethylene (LLDPE), low-density polyethylene (LDPE), medium-density polyethylene (HDPE), high-density polyethylene (HDPE), polypropylene (PP), and/or fluoropolymer. While preferred examples include a cubic-shaped first bladder 240, rectangular or cylindrical shapes may be used for the first bladder 240.

The second bladder 250 is an air-tight bladder configured to expand and contract in response to the application of pressure. In this regard, the second bladder 250 may be made from any suitable material, including the same material as the first bladder 240. Moreover, the second bladder 250 may be the same shape as the first bladder 240. Alternatively, the second bladder 250 may be the same shape as the container 210 to better fill the interior cavity of container 210 and exert pressure on first bladder 240.

Figure 3:
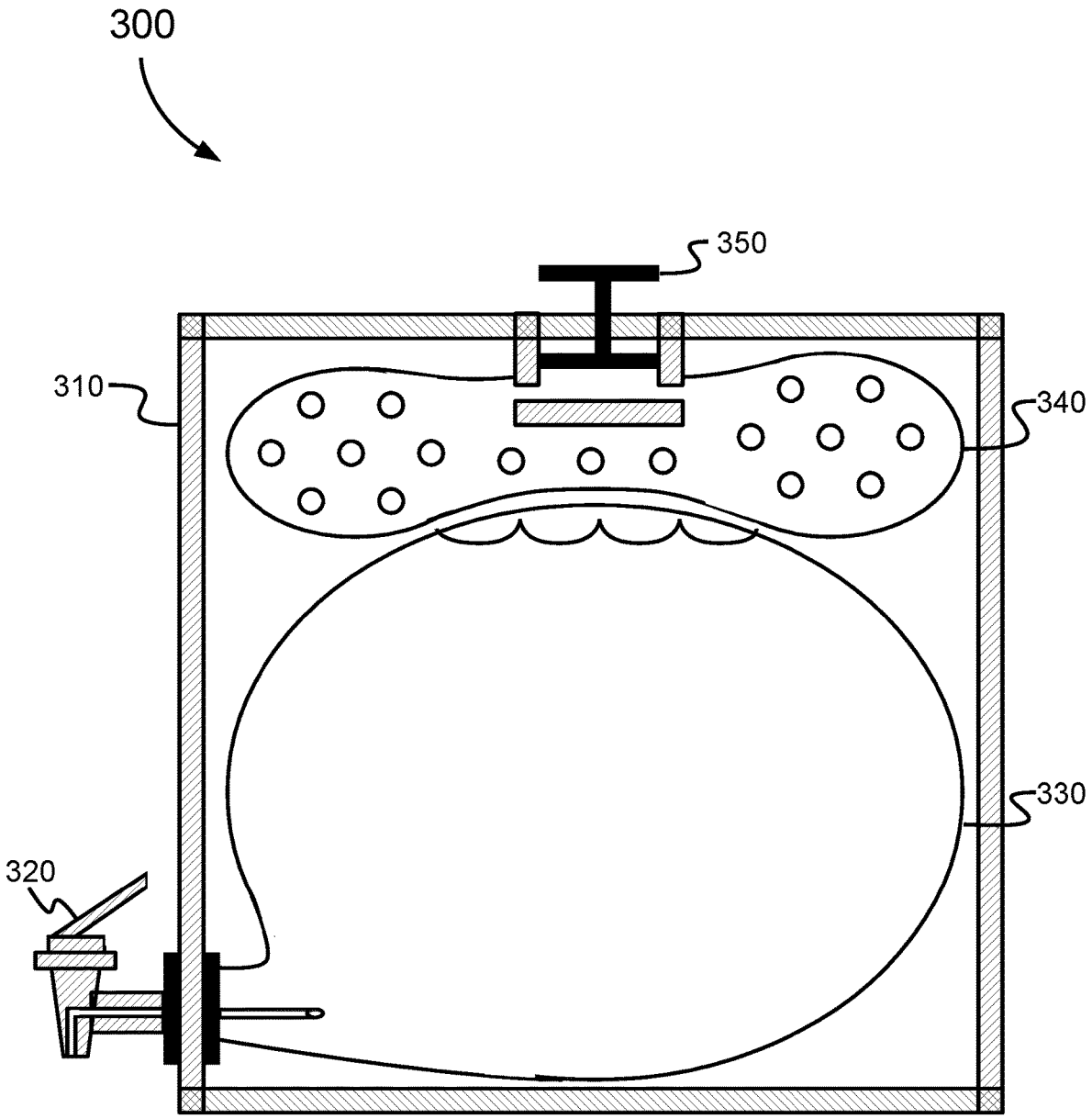
FIG. 3 illustrates another embodiment of a dual-bladder beverage dispensing system.

Turning to FIG. 3, another example of a bladder-on-bladder beverage dispensing system 300 is shown. The beverage dispensing system 300 includes a container 310. The surface of container 310 includes an outlet 320 and a pump 350, while a first bladder 330 and a second bladder 340 are disposed within the container 310. Container 310 is preferably rectangular-shaped and made from any suitable material, such as those discussed above. The bladder-on-bladder beverage dispensing system 300 does not show a support structure; however, the support structure, such as the one discussed above, may be included in the bladder-on-bladder dispensing system 300.

A previously discussed, outlet 320 may be a valve built into the container 310, such as a spigot, a faucet, one-way check valve, or a hinge-valve, that opens to release a fluid from the first bladder 330. Alternatively, outlet 320 may be an interface where a spigot, a faucet, one-way check valve, or a hinge-valve may be connected to the container 310. In this regard, the outlet 320 may include a channel connecting to the first bladder 340.

The pump 350 may also be built into the container 310. Specifically, the pump 350 may be connected to the second bladder 340 through the container 310. Preferably, pump 350 manually inflates the second bladder 340. Alternatively, pump 350 may be a disposable cartridge configured to automatically fill the second bladder 340 with a gas. According to these examples, the cartridge may be connected to the outlet 320 such that when the outlet 320 is opened the pump 350 is activated to fill the second bladder 340 with gas and dispense the liquid from the first bladder 330.

The first bladder 330 is a food-grade bladder made of any suitable material, such as one or more of the materials discussed above. The second bladder 340 is an air-tight bladder configured to expand and contract in response to the application of pressure. In operation, a user will fill second bladder 340 using pump 350. Second bladder 340 expands and exerts pressure on first bladder 330. The pressure exerted on first bladder 330 by second bladder 340 maintains a substantially constant pressure, thereby reducing the amount of carbonation that escapes from the carbonated fluid contained in first bladder 330. The pressure in second bladder 340 is increased, and the user will open outlet 320 at which time the fluid contained in first bladder 330 will flow through outlet 320. In this regard, a user may open outlet 320 after increasing the pressure on second bladder 340 or at the same time that pressure is being applied to second bladder 340.

Figure 4:
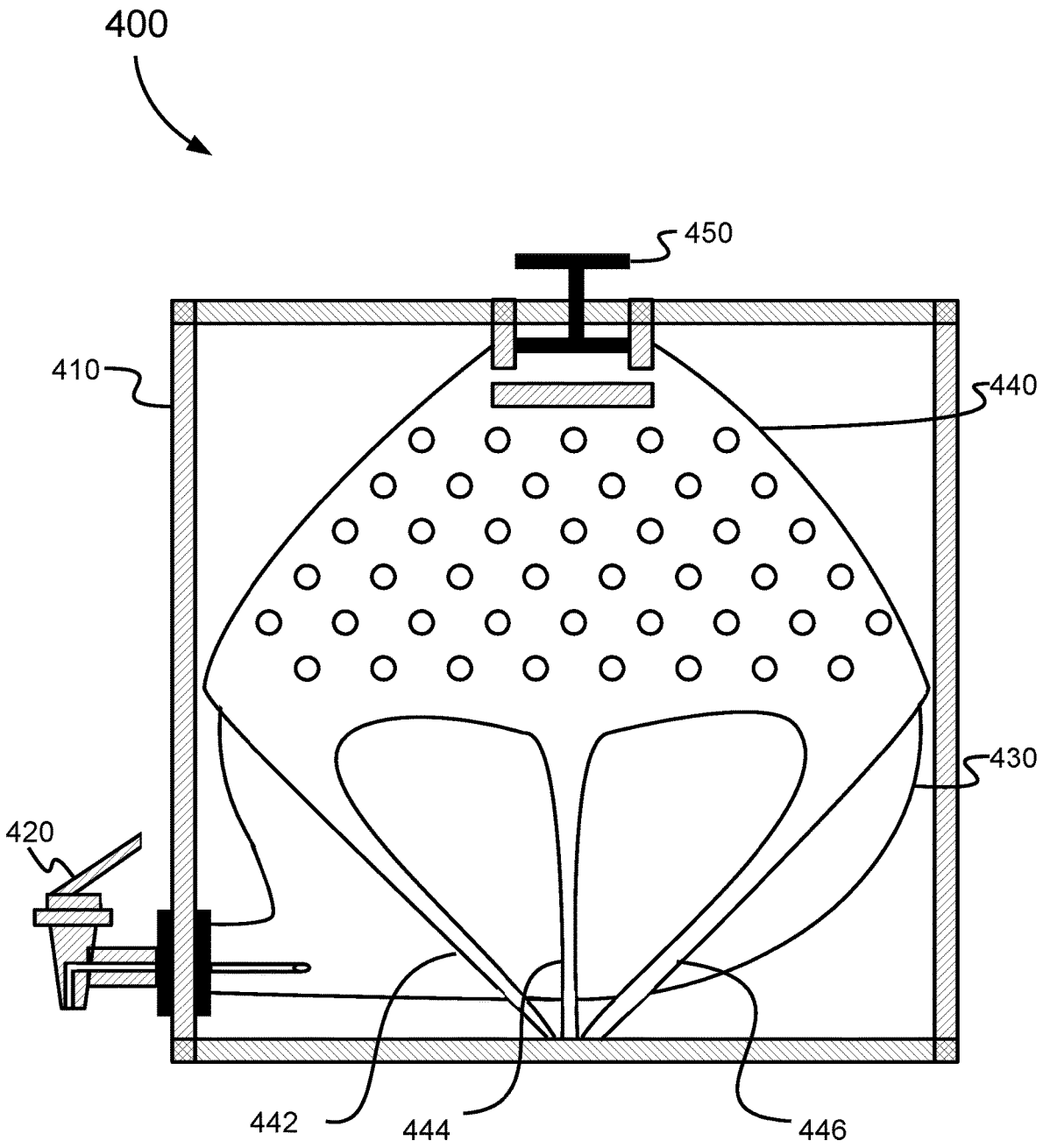
FIG. 4 shows a dual-bladder beverage dispensing system according to another embodiment.

In some embodiments, the second bladder may be attached to multiple locations on the interior of the container. FIG. 4 shows another embodiment of a bladder-on-bladder beverage dispensing system 400. The beverage dispensing system 400 includes a container 410 with an outlet 420 and a pump 450 located on the exterior surface container 410. As previously discussed, container 410 may be rectangular-shaped to maximize volumetric efficiency. A support structure (not shown), such as the one discussed above, may be included in the bladder-on-bladder dispensing system 400. Outlet 420 may be built into container 410 to release a fluid from the first bladder 430. Alternatively, outlet 430 may be an interface where a spigot, a faucet, a one-way check valve, or a hinge-valve may be connected to the container 410. In this regard, outlet 420 may be connected to first bladder 430 via a channel in container 410. Pump 450 may also be built into the container 410. In this regard, pump 450 may be connected to second bladder 440 through the container 410. According to preferred examples, pump 450 may be used to manually inflate second bladder 440. However, pump 450 may automatically inflate second bladder 440. That is, pump 450 may activate a tank or cartridge of compressed gas to release the gas second bladder 440. According to these examples, the tank or cartridge may be connected to outlet 420 such that when outlet 420 is opened, pump 450 is activated automatically to fill second bladder 440 with gas while simultaneously dispensing the liquid from first bladder 430.

As previously noted, first bladder 430 is a bladder made of any suitable, food-grade material. Second bladder 440 is an air-tight bladder configured to expand and contract in volume. Second bladder 440 may be conical shaped that encompasses first bladder 430 to maximize the volume of liquid contained within first bladder 430. According to some embodiments, second bladder 440 may include a first appendage 442, a second appendage 444, and a third appendage 446 that attach to an interior surface of container 410 to maintain the location of second bladder 440. While only three appendages are illustrated in FIG. 4, any number of appendages may be used. The appendages 442, 444, and 446 preferably connect to the bottom interior of container 410, although the appendages may be connected to any interior portion of container 410 to maintain the location of second bladder 440. Additionally, appendages 442, 444, and 446 may be extensions of second bladder 440. Alternatively, appendages 442, 444, and 446 may be a pliable material that attaches to both second bladder 440 and the interior of container 410. In operation, second bladder 440 expands in volume to compensate for the decrease in volume from first bladder 430 as liquid is dispensed via outlet 420. Accordingly, system 400 maintains a constant pressure on first bladder 430, which minimizes the amount of headspace in first bladder 440 and reduces the loss of carbonation from the liquid maintained in first bladder 440.

Figure 5:
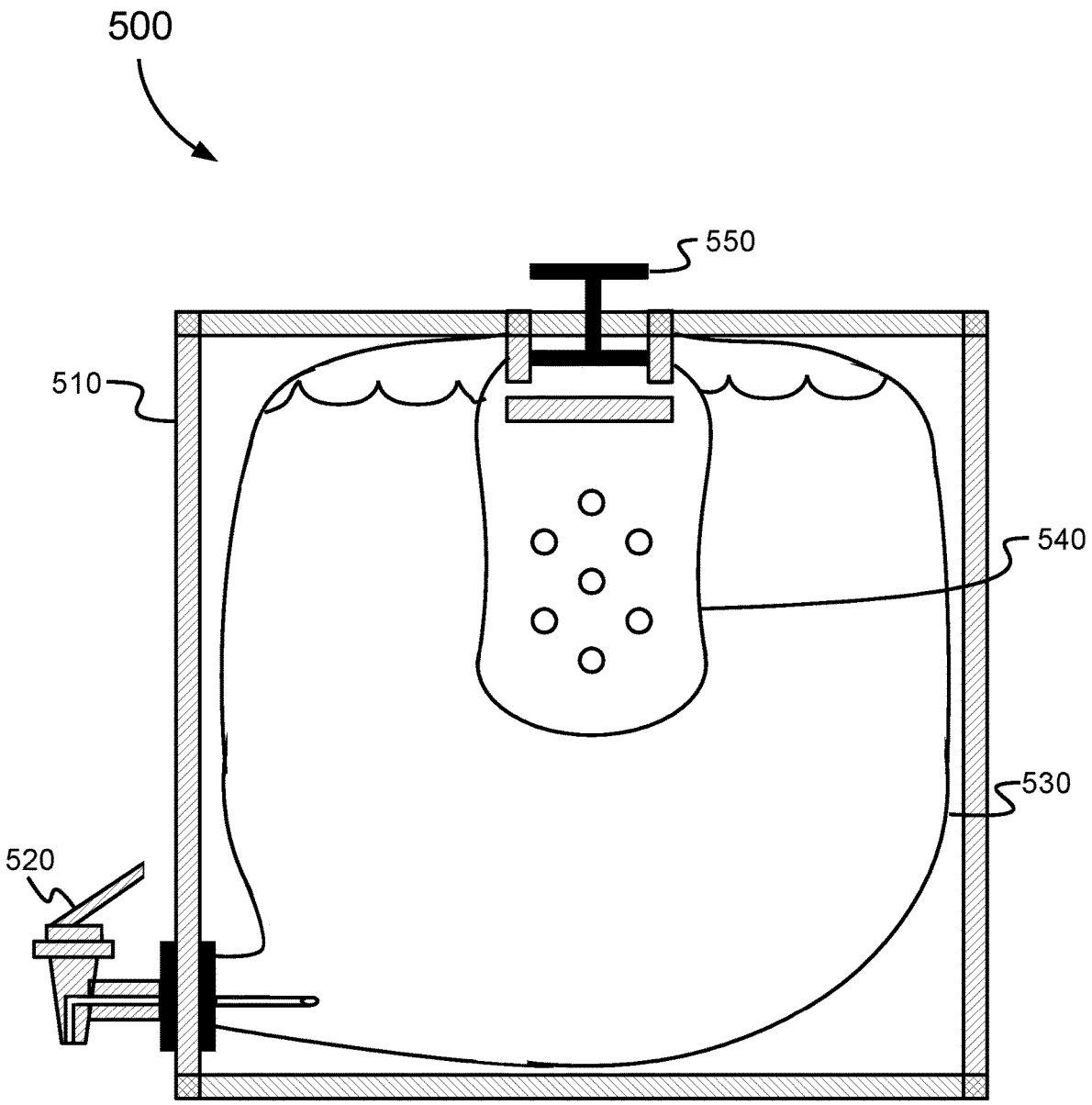
FIG. 5 shows an embodiment of a bladder-in-bladder beverage dispensing system.

According to another embodiment of the disclosure, a bladder within a bladder beverage dispensing system could be used to reduce the loss of carbonation and extend the shelf-life of the carbonated fluid. FIG. 5 illustrates an example of a bladder within a bladder beverage dispensing system 500. The bladder within a bladder beverage dispensing system 500 includes a container 510 that has an outlet valve 520 and a pump 550. Disposed within container 510 is a first bladder 530. A second bladder 540 is located within the first bladder 530.

As discussed above, the outlet 520 is preferably a valve built into the container 510, such as a spigot, a faucet, a one-way check valve, or a hinge-valve that opens to release the liquid from the first bladder 530. Alternatively, the outlet 520 may be an interface where a spigot, a faucet, or a hinge-valve may be connected to the container 510. In this regard, outlet 520 may include a channel connecting to first bladder 530. Additionally, outlet valve 520 may include an interface on the interior of container 510 for the first bladder 530 to connect to the container 510 and outlet valve 520. In this regard, first bladder 530 may be disposable or interchangeable to allow for the exchange of the first bladder.

The pump 550 may also be built into the container 510. Alternatively, the pump 550 may be an interface on the exterior surface of container 510 where a removable pump may be connected. According to other examples, pump 550 may be a disposable cartridge that connects to an interface on the exterior surface of container 510.

Similar to the bladders discussed above, the first bladder 530 is a food-grade bladder made of any suitable material. Furthermore, the second bladder 540 is an air-tight bladder configured to expand and contract in response to the application of pressure from the pump 550. The first bladder 530 and second bladder 540 may be connected. For example, the first bladder 530 and second bladder 540 may be connected via an interface that connects to top, interior surface of container 510. The interface of the first bladder 530 and second bladder 540 may interlock with a corresponding interface on the interior surface of the container 510. The interface permits pump 550 to fill the second bladder 540 with atmosphere or another type of gas, while maximizing the amount of fluid contained by the first bladder 530.

Figure 6:
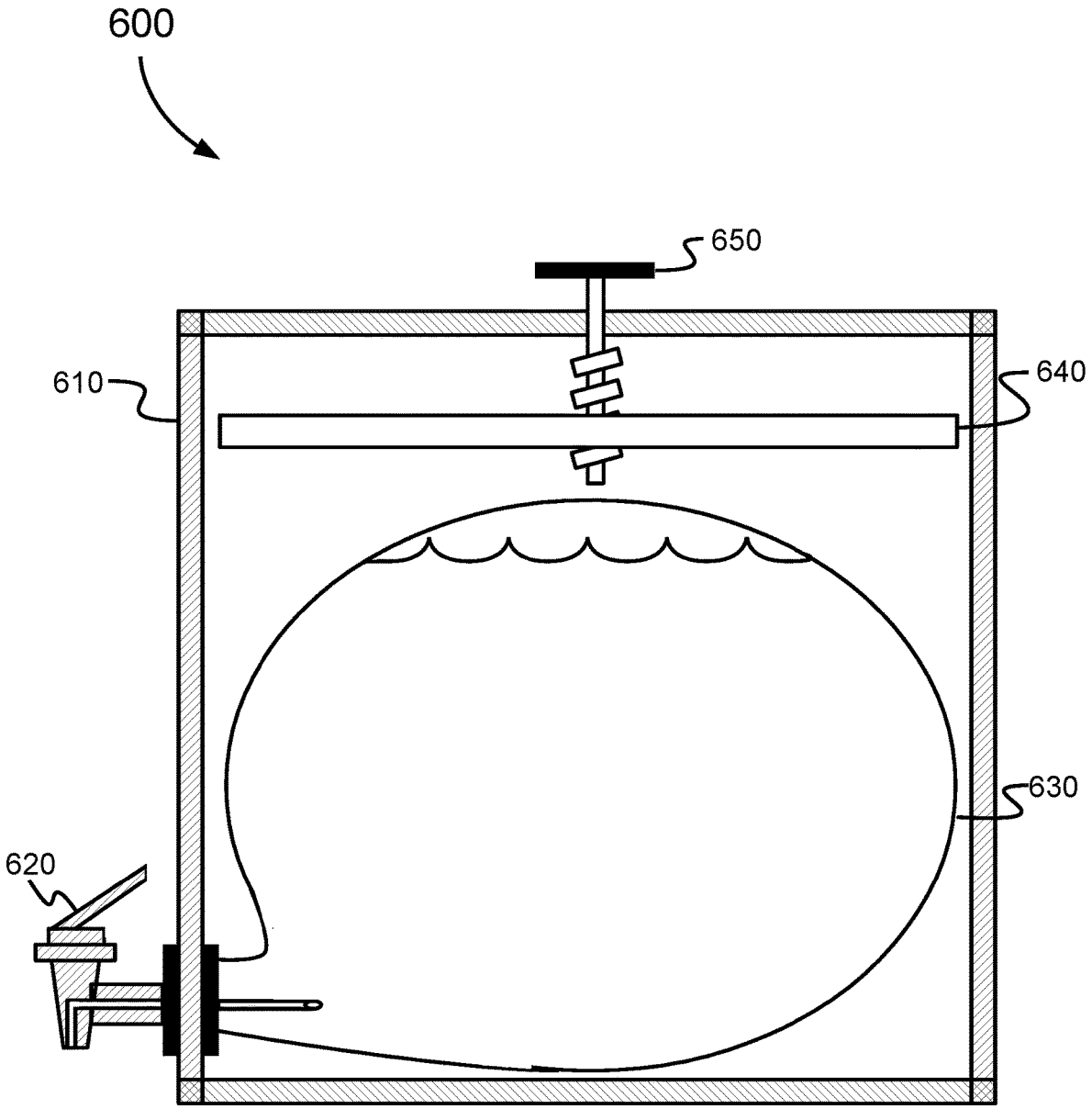
FIG. 6 illustrates another embodiment of a beverage dispensing system according to the present disclosure.

In an alternative embodiment, the beverage dispensing system of the present disclosure may use a diaphragm in lieu of a second bladder. FIG. 6 illustrates an example of a diaphragm-based beverage dispensing system 600.

The diaphragm-based dispensing system 600 includes a container 610 that has an outlet valve 620 and a knob 650. A first bladder 630 may be located within the container 610. Additionally, the dispensing system 600 includes a diaphragm 640 located within the container 610 that is connected to the knob 650 via a rod.

The outlet 620 may be a valve built into the container 610 that dispenses the liquid from the first bladder 630. Alternatively, the outlet 620 may be an interface where a spigot, a faucet, a one-way check valve, or a hinge-valve may be connected to the container 610 to dispense the liquid from the first bladder 630. Accordingly, the outlet 620 includes a channel connecting to the first bladder 630. As discussed above, the outlet valve 620 may include an interface on the interior surface of container 610 where the first bladder 630 attaches to container 610 and outlet valve 620. The first bladder 630 is a bladder made of any suitable food-grade material, as discussed above.

The diaphragm 640 may be connected to the distal end of a rod. The proximal end of the rod connects to the knob 650. In preferred embodiments, diaphragm 640 has a shape and area substantially equal to the interior of container 610. Substantially equal means that the diaphragm is a several millimeters to a few centimeters smaller than the interior area of container 610. In embodiments that include an internal support structure, substantially equal means the diaphragm is several millimeters to a few centimeters smaller than the interior area of container 610 with the support structure. In this regard, the diaphragm 640 may apply a constant pressure to the first bladder 630. In order to maintain the constant pressure, the knob 650 may vertically raise and/or lower diaphragm 640 via a screw or ratcheting mechanism.

Figure 7:
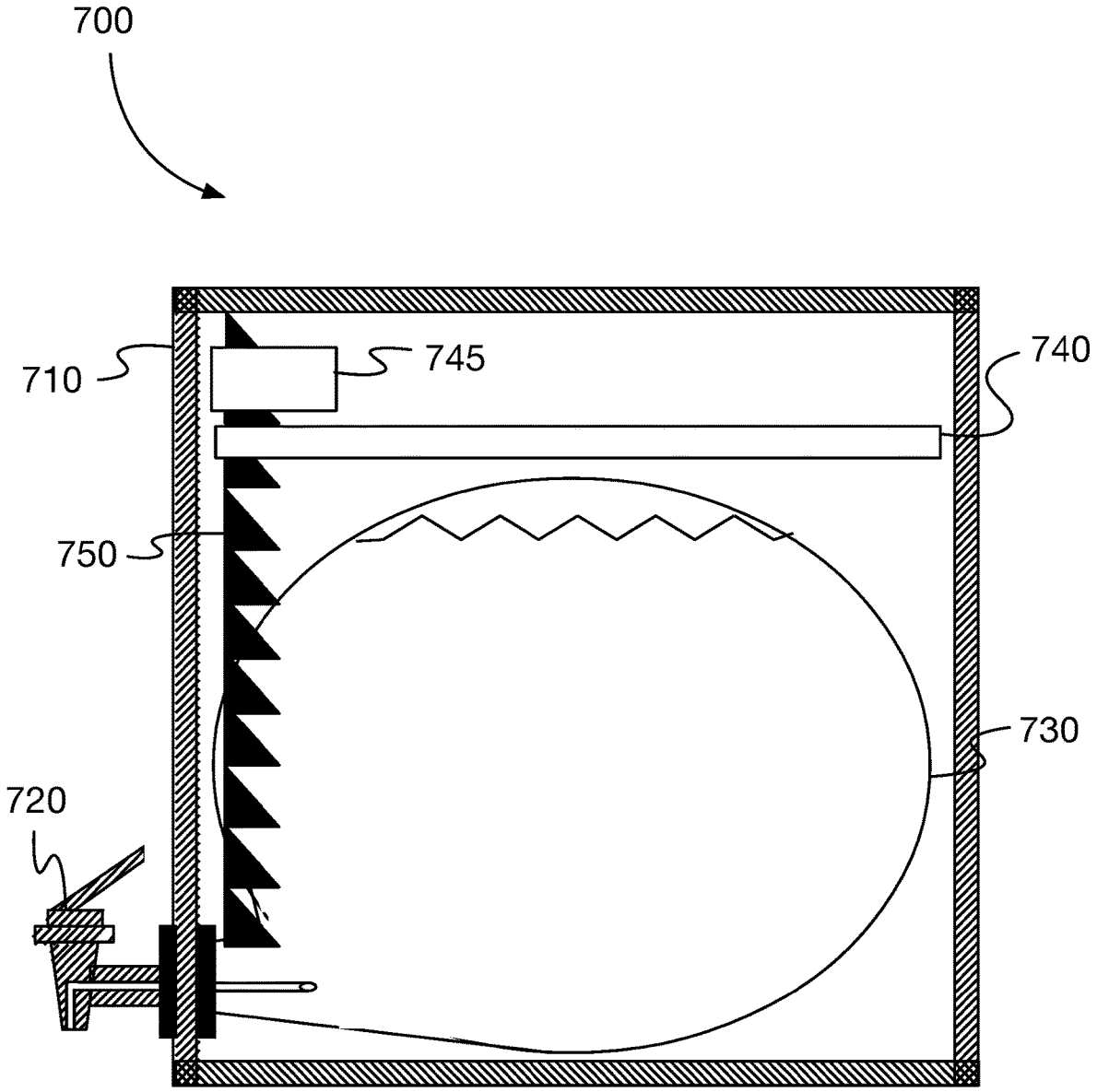
FIG. 7 shows yet another embodiment of a beverage dispensing system according to another aspect of the disclosure.

FIG. 7 illustrates an example of a diaphragm-based beverage dispensing system 700. The diaphragm-based dispensing system 700 includes a container 710 that has an outlet valve 720, a first bladder 730, a diaphragm 740, a ratcheting mechanism 750, and a motor 745. The outlet 720 may be any of the valves described above. The first bladder 730 may be constructed from any suitable food-grade material, as discussed above. Diaphragm 740 may have a shape and area substantially equal to the interior of container 710. The diaphragm 740 may apply a constant pressure to the first bladder 730. In order to maintain the constant pressure, the diaphragm 740 may be raised or lowered vertically via ratcheting mechanism 750 and motor 745.

In the embodiments described above, a rectangular shape is preferred for the container since a rectangular shape provides greater volumetric efficiency. That is, more fluid may be stored in rectangular-shaped containers than cylindrical containers. For example, a typical six-pack of bottles of beer is 5 inches wide, 7 inches deep, and 8¼ inches tall, holding 72 fluid ounces (6 bottles, each holding 12 fluid ounces) and occupying approximately 290 cubic inches. By comparison, a 6 inch wide, 6 inch deep, and 6 inch tall implementation of beverage dispensing system 200 would hold approximately 120 fluid ounces and occupy 216 cubic inches of space. Table 1 below illustrates the benefits of implementing a rectangular-shaped container for beverage dispensing system 200.

TABLE 1

| edge of cube (in) | volume (in3) | volume (gal) | volume (fl oz) | # 12 fl oz servings |
|---|---|---|---|---|
| 6 | 216 | 0.94 | 120 | 10 |
| 7 | 343 | 1.48 | 190 | 16 |
| 8 | 512 | 2.22 | 284 | 24 |
| 9 | 729 | 3.16 | 404 | 34 |
| 10 | 1000 | 4.33 | 554 | 46 |
| 11 | 1331 | 5.76 | 738 | 61 |
| 12 | 1728 | 7.48 | 958 | 80 |
| 13 | 2197 | 9.51 | 1217 | 101 |
| 14 | 2744 | 11.88 | 1520 | 127 |
| 15 | 3375 | 14.61 | 1870 | 156 |
| 16 | 4096 | 17.73 | 2270 | 189 |
| 17 | 4913 | 21.27 | 2722 | 227 |
| 18 | 5832 | 25.25 | 3232 | 269 |
| 19 | 6859 | 29.69 | 3801 | 317 |
| 20 | 8000 | 34.63 | 4433 | 369 |

As illustrated above, the embodiments described in the present application allow for beverage companies to transport the same amount of volume in less space using smaller, uniform containers. Accordingly, the embodiments described herein provide for more efficient packing for shipping and storing purposes. That is, the present invention allows the same volume to be distributed in a smaller, uniformly shaped container allowing for more containers to be transported and/or stored. To further illustrate the advantages of the present disclosure, Table 2 below compares several common containers to examples of the present invention to illustrate how the embodiments provide an equal amount of volume using less space and fewer resources, which results in greater packing efficiency.

TABLE 2

| | nominal outer dimensions of container | | | | | | |
|---|---|---|---|---|---|---|---|
| | length (in) | width (in) | height (in) | volume of container (in3) | volume of container (gallons) | volume of beverage (gallons) | volumetric packing efficiency |
| case of cans | 15.75 | 10.5 | 4.75 | 786 | 3.40 | 2.25 | 66% |
| case of bottles | 14 | 9.75 | 9.25 | 1263 | 5.47 | 2.25 | 41% |
| 8.5 in edge cube | 8.5 | 8.5 | 8.5 | 614 | 2.66 | 2.25 | 85% |
| ⅙ barrel | 9.25 | diameter | 23.375 | 1571 | 6.80 | 5.17 | 76% |
| 11 in edge cube | 11.25 | 11.25 | 11.25 | 1424 | 6.16 | 5.17 | 84% |
| ¼ barrel | 16.125 | diameter | 13.875 | 2833 | 12.27 | 7.75 | 63% |
| ¼ barrel slim | 11.125 | diameter | 23.375 | 2272 | 9.84 | 7.75 | 79% |
| 12.75 in edge cube | 12.75 | 12.75 | 12.75 | 2073 | 8.97 | 7.75 | 86% |

Assuming packing efficiency is determined as the volume of the beverage divided by the total volume of the beverage and its container. In this regard, a case of cans and a case of bottles (both of which contain 2.25 gallons) have an efficiency of 66% and 41%, respectively. In comparison, the beverage dispensing system described herein can transport the same volume (e.g., 2.25 gallons) in less space and making use of fewer resources, which results in a packing efficiency of 85%. On average, the beverage dispensing systems described herein result in approximately an 85% packing efficiency, while the most efficient of conventional containers only have a packing efficiency of 79%. Thus, the beverage dispensing system described herein provides improvements and advantages over prior art systems.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

We claim:

1. A beverage dispensing system for reducing formation of headspace comprising:

a container comprising:

a base; and a plurality of interconnected panels connected to the base to form the container, wherein at least one of the plurality of panels comprises an opening configured to receive an outlet;

a first bladder storing a carbonated fluid fitting within the container and comprising an outlet channel, wherein the first bladder comprises food grade material;

a valve connected to the outlet channel of the bladder, wherein the valve opens and closes to control a flow of the carbonated fluid from the first bladder;

a ratcheting mechanism for exerting a constant pressure on the first bladder to reduce formation of carbon dioxide in a headspace of the first bladder; and a motor configured to raise or lower a diaphragm attached to a distal end of the ratcheting mechanism.

2. The beverage dispensing system of claim 1, wherein the container comprises a water-resistant coating.

3. The beverage dispensing system of claim 1, wherein the container is made of a waterproof material.

4. The beverage dispensing system of claim 1, wherein the valve comprises at least one of: a faucet, a one-way check valve, or a hinge-valve.

5. The beverage dispensing system of claim 1, further comprising a support structure disposed within the container.

6. The beverage dispensing system of claim 5, wherein the support structure is separate and distinct from the container.

7. The beverage dispensing system of claim 5, wherein the support structure comprises one or more compartments capable of storing cooling material.

8. The beverage dispensing system of claim 5, wherein the support structure comprises a compartment for holding the first bladder.

9. The beverage dispensing system of claim 5, wherein the support structure comprises at least one of: polyurethanes, polyesters, epoxy resins, or phenolic resins.

10. The beverage dispensing system of claim 1, wherein the food grade material comprises at least one of: polyethylene terephthalate (PET), polyethylene naphthalate (PEN), poly(butylene 2,6-naphthalate) (PBN), polyethylene (PE), linear low-density polyethylene (LLDPE), low-density polyethylene (LDPE), medium-density polyethylene (MDPE), high-density polyethylene (HDPE), polypropylene (PP), fluoropolymer, Polychlorotrifluoroethylene (PCTFE), polytetrafluoroethylene (PTFE), fluorinated ethylene propylene (FEP), or perfluoroalkoxy (PFA).

11. The beverage dispensing system of claim 1, wherein the food grade material comprises at least one of: a nylon, a plastic, an ethylene-vinyl alcohol copolymer, a polyolefin, a natural polymer, or a synthetic polymer.

12. The beverage dispensing system of claim 1, wherein the base and the plurality of interconnected panels form a rectangular shape.

13. The beverage dispensing system of claim 1, wherein the first bladder is cube-shaped.

14. The beverage dispensing system of claim 1, wherein the valve is affixed to the outlet channel of the first bladder.

15. The beverage dispensing system of claim 1, wherein the valve comprises an interface to connect to the outlet channel of the first bladder.

* * * * *